United States Patent [19]

Thebert

[11] 4,373,859

[45] Feb. 15, 1983

[54] UNISON RING SUPPORT SYSTEM

[75] Inventor: Glenn W. Thebert, Carmel, Ind.

[73] Assignee: General Motors Corporation, Detroit, Mich.

[21] Appl. No.: 304,963

[22] Filed: Sep. 23, 1981

[51] Int. Cl.[3] ..... F01D 17/16

[52] U.S. Cl. ..... 415/159; 415/134

[58] Field of Search ..... 415/156, 159, 134, 160; 248/674, 603, 637

[56] References Cited

U.S. PATENT DOCUMENTS

| | | | |
|---|---|---|---|
| 2,923,459 | 2/1960 | Taylor | 415/159 |
| 3,667,860 | 6/1972 | Endress et al. | 415/150 |
| 4,314,791 | 2/1982 | Weiler | 415/159 |

*Primary Examiner*—Harvey C. Hornsby
*Assistant Examiner*—B. Bowman
*Attorney, Agent, or Firm*—Saul Schwartz

[57] ABSTRACT

In a turbomachine having a cylindrical casing, a stage of adjustable vane assemblies including vanes rotatable on the casing and actuating arms rotatable with the vanes, a unison ring around the casing, and bearing means between each actuating arm and the unison ring operative to rotate each arm in unison with the unison ring while permitting relative radial thermal growth of the vanes and arms incident to temperature changes during machine operation, a support system for the unison ring including three radially inwardly directed attachment nodes on the unison ring and three Bowden cable assemblies on the casing between the attachment nodes, the Bowden cable assemblies having push-pull elements capable of force transmission only lengthwise pivotally connected to each attachment node with ends directed generally tangent to a circle defined by the cable assemblies so that net forces exerted by the push-pull elements to support the unison ring are directed tangent to the circle.

3 Claims, 6 Drawing Figures

UNISON RING SUPPORT SYSTEM

BACKGROUND OF THE INVENTION

This invention relates generally to turbomachines of the type having adjustable vane stages and, more particularly, to an improvement in support systems for vane operating unison rings.

In turbomachines, such as axial flow compressors, where stator or casing mounted vanes direct the flow of fluid impelled by rotor mounted blades, enhanced performance has been achieved by mounting the stator vanes for positional adjustment relative to the rotating blades. Typically, in adjustable vane arrangements each vane in a stage of adjustable vanes has a shaft rotatably supported on a casing of the turbomachine and each shaft has rigidly connected to it an actuating arm so that pivotal movement of the actuating arms effects concurrent rotation of the shafts and the attached vanes. Simultaneous pivotal movement of each of the actuating arms in a vane stage is typically effected by a unison ring disposed around the casing and connected to the actuating arms through bearings. In heretofore proposed systems for supporting unison rings relative to casings and for connecting unison rings to individual actuating arms, relatively complex and expensive structural combinations have been provided to effect support of the rings independently of the actuating arms. The purpose of such independent support is minimization of forces on the vane shafts which tend to tilt or cock the shafts in their mountings and thus increase the force level necessary for vane adjustment. A novel unison ring support system according tc this invention embodies simplified and effective structure for supporting the unison ring on the turbomachine casing independently of the actuating arms and, thus, represents an improvement over other heretofore known systems.

SUMMARY OF THE INVENTION

Accordingly, the primary feature of this invention is that it provides a new and improved system for supporting a variable vane actuating unison ring on a turbomachine casing independently of actuating arms connected to individual adjustable vanes. Another feature of this invention resides in the provision in the new and improved unison ring support system of a plurality of Bowden cable assemblies on the casing disposed between and operatively connected to attachment nodes on the unison ring, the Bowden cable assemblies functioning to support the ring on the casing essentially independently of the vane actuating arms and in centered relationship with respect to a longitudinal axis of the casing. Still another and more specific feature of this invention resides in the provision in the new and improved unison ring support system of a unison ring disposed around the turbomachine casing and three Bowden cable assemblies disposed in an annulus between the unison ring and the turbomachine casing and in interstices between three evenly spaced radially inwardly directed attachment nodes on the unison ring, each Bowden cable assembly including a push-pull element having a first end pivotally connected to a pin at a corresponding one of the attachment nodes and a second end pivotally connected to the same pin as the first end of the next succeeding push-pull element so that the three push-pull elements are arranged in a circle and develop net forces on the unison ring essentially tangent to the circle defined by the push-pull elements which forces resist displacement of the ring from centered relationship about the longitudinal axis of the casing.

These and other features of this invention will be readily apparent from the following specification and from the drawings wherein.

Figure 1:
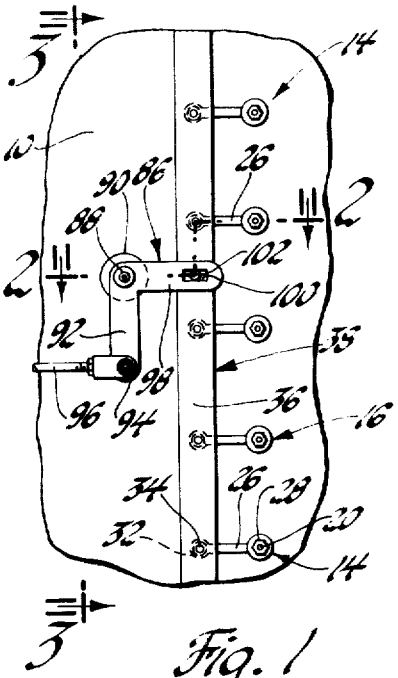
FIG. 1 is a view of a portion of the exterior of a turbomachine having a stage of adjustable stator vanes and including a new and improved unison ring support system according to this invention.
Figure 2:
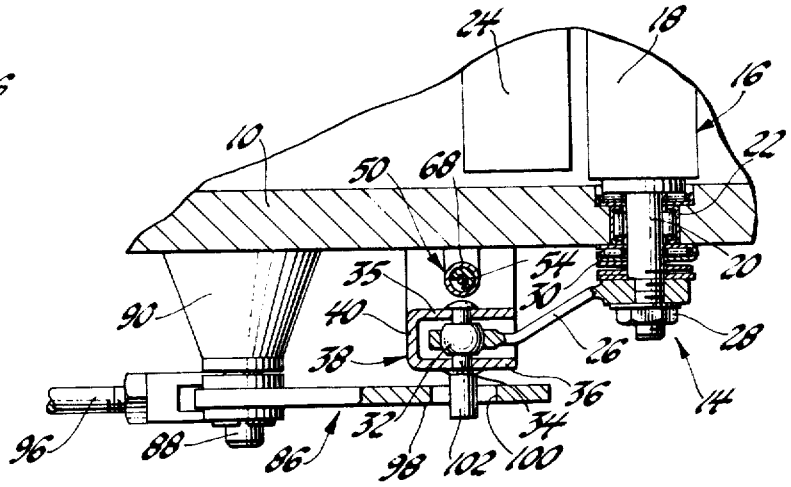
FIG. 2 is an enlarged sectional view taken generally along the plane indicated by lines 2—2 in FIG. 1.
Figure 3:
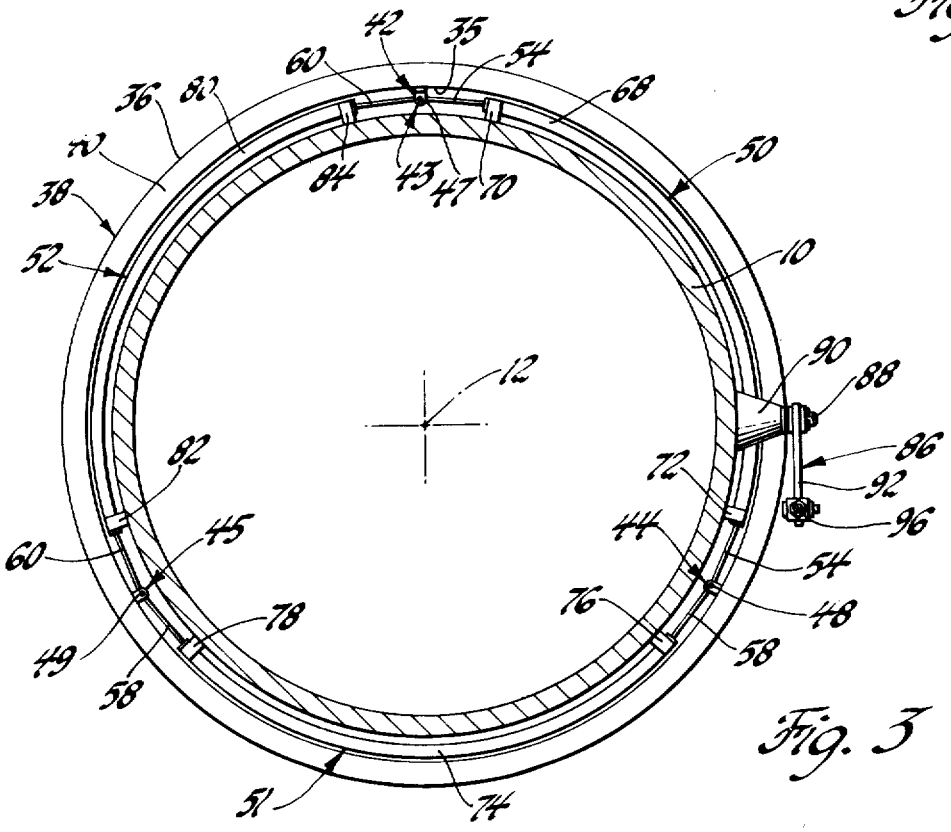
FIG. 3 is a partially broken away sectional view taken generally along the plane indicated by lines 3—3 in FIG. 1 and showing only a complete unison ring support system according to this invention and the turbomachine casing.

Referring now to FIGS. 1, 2 and 3 of the drawings, a turbomachine includes a cylindrical casing 10 disposed about a longitudinal axis 12 of the turbomachine. A stage 14 of individual adjustable stator vane assemblies 16 is disposed around the casing 10 in a plane perpendicular to the axis 12, each vane assembly including a vane 18 having an integral shaft 20 supported on the casing by a bearing assembly 22 for rotation about a radially oriented axis through the shaft. The vanes cooperate in known manner with a plurality of blades on a rotor of the turbomachine, only a single rotor blade 24 being shown in FIG. 2, in directing through the turbomachine fluid impelled by the rotor blades. In a preferred embodiment, the turbomachine is an axial flow compressor wherein the blades 24 and vanes 18 cooperate to progressively compress air from atmospheric pressure to a higher pressure suitable for sustaining combustion in a combustor of a gas turbine engine. Further, while only a single row of blades 24 and a single stage 14 of adjustable vane assemblies are shown and described herein, it is to be understood that plural blade rows and vane stages are contemplated.

With continued reference to FIGS. 1, 2 and 3, an actuating arm 26 is rigidly attached to the outboard end of shaft 20 in each of the vane assemblies 16 and rotates as a unit with the corresponding vane 18 about the radially oriented axis of the shaft. A nut 28 on a threaded portion of the shaft 20 retains the actuating arm against the pressure of a spring 30 disposed between the bearing assembly 22 and the actuating arm. The details of the attachment arrangement between the vane assemblies 16 and the casing 10 represents no part of this invention and may assume any number of functionally identical forms known in the art.

The end of the actuating arm 26 remote from the shaft 20 includes a bearing portion 32 which slidably receives a radially directed trunion 34, FIG. 2, rigidly disposed between a pair of flanges 35 and 36 of a unison ring 38, the unison ring 38 being disposed around the casing 10 in a transverse plane perpendicular to the axis 12. The flanges 35 and 36 are rigidly connected by a web 40 integral with the flanges so that the ring 38 itself forms a rigid structure. Each of the actuating arms 26 is thus connected to the unison ring such that rotation of the ring about the axis 12 effects simultaneous pivotal movement of the actuating arms and corresponding rotation of the shafts 20 and the vanes 18 in each vane assembly for vane positional adjustment. In addition, the radial orientation of each of the trunnions 34 accommodates relative sliding movement of the bearing portions 32 in the radial direction so that relative radial thermal growth of the casing due to temperature changes incident to operation of the turbomachine does not cause development of bending loads on the actuating arms tending to tilt or cock the shafts 20 in the bearing assemblies 22.

Even though the trunnions 34, radially oriented between the flanges 35 and 36, cooperate with the bearing portions 32 and the arms 26 in inherently supporting the weight of the unison ring, it is desirable for the reason alluded to hereinbefore to otherwise support the unison ring independently of the actuating arms 26. To this end a unison ring support system according to this invention and designated generally 42, FIG. 3, is provided between the casing 10 and the unison ring. The support system 42 includes a first attachment node 43, a second attachment node 44, and a third attachment node 45 each rigidly attached to the flange 35 at equal intervals around the ring and projecting radially inward into an annulus defined between the ring and the casing 10. As seen best in FIGS. 4 and 5, the attachment nodes are identical and each includes a pair of spaced lugs 46 rigidly attached to the radially innermost surface of the flange 35, as by welding. First attachment node 43 supports a pin 47, FIG. 5, while attachment nodes 44 and 45 support similar pins 48 and 49, respectively, FIG. 3. While in the preferred embodiment the attachment nodes 43, 44 and 45 are evenly spaced at 120° intervals around the inner diameter of the unison ring, it will be understood that alternative spacing of three or more attachment nodes is contemplated by the invention.

The unison ring support system 42 further includes a first Bowden cable assembly 50 between attachment nodes 43 and 44, a second Bowden cable assembly 51 between attachment nodes 44 and 45, and a third Bowden cable assembly 52 between attachment nodes 45 and 43. First Bowden cable assembly 50 includes a first wire-like push-pull element 54 capable of force transmission only lengthwise and having a first looped end 56, FIGS. 4 and 5, pivotally attached to pin 47 in first attachment node 43. A second looped end of the first push-pull element 54, not shown, is similarly pivotally connected to pin 48 at the second attachment node 44 so that the first push-pull element is thus disposed in an arc in the interstice defined between the first and second attachment nodes and in the annulus between flange 35 of the unison ring and the casing 10. A second wire-like push-pull element 58 of second Bowden cable assembly 51, also capable of force transmission only lengthwise, includes a first looped end, not shown, pivotally supported on pin 48 at the second attachment node 44 and a second looped end, not shown, pivotally supported on pin 49 at the third attachment node 45 so that the second push-pull element is disposed in an arc in the interstice between the second and third attachment nodes and in the annulus between the flange 35 of the unison ring and the casing 10. A third wire-like push-pull element 60 of third Bowden cable assembly 52, again capable of force transmission only lengthwise, includes a first looped end pivotally supported on pin 49 at third attachment node 45 and a second looped end 62, FIGS. 4 and 5, supported on pin 47 at the first attachment node 43. Again, the third push-pull element 60 is thus disposed in an arc in the interstice between the third and first attachment nodes 45 and 43 and in the annulus between the flange 35 of the unison ring and the casing 10. The push-pull elements 54, 58 and 60 thus form essentially a circle around the casing 10 with the first end of each push-pull element pivotally connected to the second end of the next succeeding push-pull element.

Figure 4:
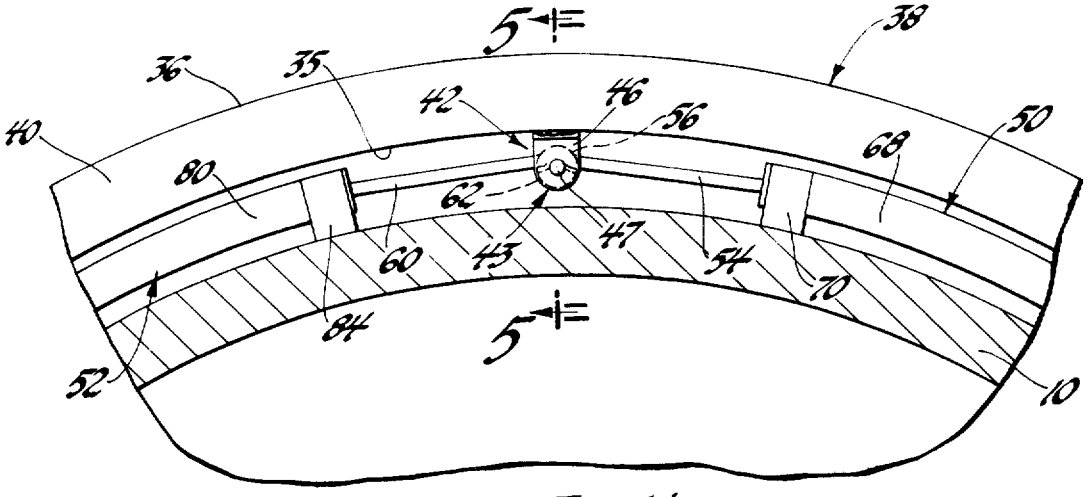
FIG. 4 is an enlarged view of a portion of FIG. 3 showing particularly the connection of the Bowden cable assemblies to the turbomachine and to the attachment nodes on the unison ring.
Figure 5:
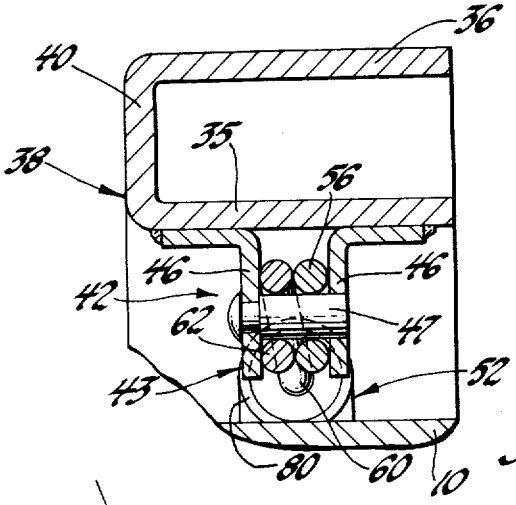
FIG. 5 is a sectional view taken generally along the plane indicated by lines 5—5 in FIG. 4.

As seen best in FIGS. 3 and 4, first Bowden cable assembly 50 further includes a first cylindrical sheath 68 rigidly attached to the casing 10 generally adjacent the first node 43 by a bracket 70 and adjacent the second attachment node 44 by a bracket 72, the sheath 68 slidably receiving first push-pull element 54 in known fashion. The second push-pull element 58 of second Bowden cable assembly 51 is similarly slidably received in a second sheath 74 rigidly connected to the casing 10 adjacent the second node 44 by a bracket 76 and adjacent the third attachment node 45 by a bracket 78. A third sheath 80 of third Bowden cable assembly 52 slidably receives the third push-pull element 60 and is rigidly attached to the casing 10 adjacent the third attachment node 45 by a bracket 82 and adjacent the first attachment node 43 by a bracket 84. As described more fully hereinafter, the sheaths 68, 74, and 80 guide the first and second ends of push-pull elements 54, 58, and 60, respectively, such that the net forces developed on the unison ring by the push-pull elements are directed tangent to the circle described by the Bowden cable assemblies. The net forces thus developed function to support the unison ring on the casing in centered relationship with respect to longitudinal axis 12.

As seen best in FIGS. 1, 2 and 3, means are provided to rotate the unison ring 38 about the axis 12 including a bell crank 86 rotatably supported on a pin 88 rigidly projecting from a mounting structure 90 disposed on the casing 10. The bell crank 86 includes a first arm 92 pivotally connected at 94 to an operating link 96 and a second arm 98 disposed generally parallel to the longitudinal axis 12 of the turbomachine and overlying the unison ring 38. A slot 100 in the second arm 98 slidably receives a pin or abutment 102 rigidly attached to flange 36 of the unison ring. Accordingly, reciprocation of the link 96 in the axial direction pivots the bell crank 86 about the pin 88 causing lateral displacement of the slot 100 and corresponding lateral displacement of the pin 102 thereby applying tangential force to the unison ring 38 for rotating the latter about the longitudinal axis 12. The longitudinal sides of the slot 100 generally closely receive the pin 102 while the excess length of the slot 100 relative to the diameter of the pin 102 permits limited displacement of the unison ring longitudinally and radially to accommodate whatever limited thermal growth may occur during normal engine operation.

Figure 6:
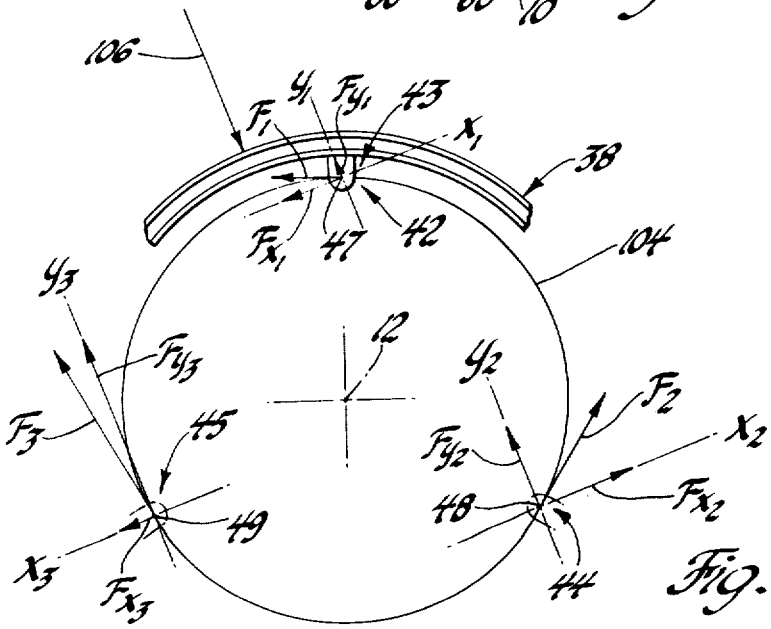
FIG. 6 is a free body diagram of the unison ring illustrating how external forces applied to the unison ring are resisted by the Bowden cable assemblies.

Analyzing now the support of the unison ring by Bowden cable assemblies 50, 51, and 52 and referring particularly to FIG. 6, the unison ring 38 can be assumed to be supported only at the three pins 47, 48 and 49 in the attachment nodes 43, 44 and 45 respectively. Further, since the push-pull elements 54, 58 and 60 transmit forces only lengthwise and are arranged in a circle 104, FIG. 6, about the axis 12 with attachment to the ring 38 only at pins 47, 48 and 49, the net or resultant forces exerted by the push-pull elements on the ring to resist or balance an external force represented by a force vector 106 must necessarily act tangent to circle 104, the resultant forces being identified as $F_1$, $F_2$ and $F_3$ through pins 47, 48 and 49 respectively. For purposes of determining the force distribution between the attachment nodes 43, 44 and 45, sets of vertical and parallel coordinate axes can be established at each pin 47, 48 and 49 such that vertical coordinate axes $Y_1$, $Y_2$ and $Y_3$ through pins 47, 48 and 49, respectively, extend parallel to the direction of force vector 106 while horizontal coordinate axes $X_1$, $X_2$ and $X_3$ through pins 47, 48 and 49, respectively, project perpendicular to the corresponding Y coordinates. With the unison ring 38 being in equilibrium, the magnitude of force 106 being known, and the directions of the resultant forces at pins 47, 48 and 49 being tangent to circle 104, and therefore of known direction relative to the direction of force vector 106, three independent equations can be derived involving only known quantities and the unknown magnitudes of resultant forces $F_1$, $F_2$ and $F_3$ so that the unknown magnitudes can be calculated. Having thus derived the magnitudes of the forces $F_1$, $F_2$ and $F_3$, graphic resolution of each resultant force along respective X and Y coordinate axes can be effected to define three vertical component force vectors $FY_1$, $FY_2$ and $FY_3$ at pins 47, 48 and 49, respectively and to define three horizontal component force vectors $FX_1$, $FX_2$ and $FX_3$ at pins 47, 48 and 49. Analysis of this graphic representation of the static equilibrium condition yields the conclusion that forces in the Y-coordinate direction equal the vector force 106 so there is no tendency for unison ring 38 to be displaced in that direction. Similarly, forces in the X-coordinate direction balance each other so that, assuming the unison ring rigid enough to internally withstand these component forces, there is no tendency for the unison ring to be displaced in the X-coordinate direction. It is, accordingly, seen that the Bowden cable assemblies 50, 51, and 52 disposed in a circle around the casing 10 function to support the unison ring independently of the actuating arms 26 and to resist forces tending to displace the ring from centered relationship with respect to axis 12.

With respect now to external forces tangent to the unison ring, as occur when bell crank 86 through pin 102 resists gas pressure forces on the vanes 18 as transmitted back to the ring through shafts 20, actuating arm 26, bearing portions 32 and trunnion 34, there is no tendency for the ring to be displaced from centered relationship around axis 12. Should this or other sources of external force application develop forces in other than the tangential direction which could displace the unison ring from centered relationship about axis 12, then the Bowden cable assemblies operate as described hereinbefore to resist such displacement and maintain the unison ring centered about axis 12.

The embodiments of the invention in which an exclusive property or privilege is claimed are defined as follows:

1. In a turbomachine having a casing and a stage of adjustable vane assemblies disposed on said casing, each of said vane assemblies including a vane rotatable on said casing and an actuator arm attached to said vane for unitary rotation therewith, the combination comprising, a rigid unison ring disposed in a transverse plane of said casing perpendicular to a longitudinal axis of said turbomachine, connecting means between said unison ring and each of said actuating arms operative to effect pivotal movement of said actuating arms and rotation of said vanes in unison with and in response to rotation of said unison ring about said longitudinal axis while permitting relative radial thermal growth between each of said actuating arms and said unison ring during temperature changes incident to operation of said turbomachine, a plurality of angularly spaced attachment nodes exceeding two in number on said unison ring, a corresponding plurality of push-pull elements capable of force transmission only lengthwise, each of said push-pull elements having a first end pivotally connected to one of said attachment nodes and a second end pivotally connected to the one of said attachment nodes to which said first end of the next succeeding push-pull element is attached, and a corresponding plurality of sheath members each slidably receiving a respective one of said push-pull elements and having rigid attachment at opposite ends to said casing, each of said sheath members directing said first and said second ends of a corresponding one of said push-pull elements generally tangent to a circle in said transverse plane about said longitudinal axis so that said plurality of push-pull elements resist displacement of said unison ring in said transverse plane from centered relationship about said longitudinal axis independently of said bearing means with net forces on said attachment nodes directed generally tangent to said circle.

2. In a turbomachine having a casing and a stage of adjustable vane assemblies disposed on a casing, each of said vane assemblies including a vane rotatable on said casing and an actuator arm attached to said vane for unitary rotation therewith, the combination comprising, a rigid unison ring disposed in a transverse plane of said casing perpendicular to a longitudinal axis of said turbomachine, bearing and trunnion means between said unison ring and each of said actuating arms operative to effect pivotal movement of said actuating arms and rotation of said vanes in unison with and in response to rotation of said unison ring about said longitudinal axis while permitting relative radial thermal growth between each of said actuating arms and said unison ring during temperature changes incident to operation of said turbomachine, a plurality of attachment nodes on said unison ring exceeding two in number and angularly spaced at equal intervals around said unison ring, a corresponding plurality of push-pull elements capable of force transmission only lengthwise and disposed in interstices between said attachment nodes, each of said push-pull elements having a first end pivotally connected to one of said attachment nodes and a second end pivotally connected to the one of said attachment nodes to which said first end of the next succeeding push-pull element is attached, a corresponding plurality of sheath members each slidably receiving a respective one of said push-pull elements and having rigid attachment at opposite ends generally adjacent respective ones of said attachment nodes to said casing, each of said sheath members directing said first and said second ends of a corresponding one of said push-pull elements generally tangent to a circle in said transverse plane about said longitudinal axis so that said plurality of push-pull elements resist displacement of said unison ring in said transverse plane from centered relationship about said longitudinal axis independently of said bearing and trunnion means with net forces on said attachment nodes directed generally tangent to said circle, and actuating means between said casing and said unison ring operative to effect rotation of said unison ring about said longitudinal axis.

3. In a turbomachine having a casing and a stage of adjustable vane assemblies disposed on a casing, each of said vane assemblies including a vane rotatable on said casing and an actuator arm attached to said vane for unitary rotation therewith, the combination comprising, a rigid unison ring disposed around said casing in a transverse plane perpendicular to a longitudinal axis of said turbomachine, bearing and trunnion means between said unison ring and each of said actuating arms operative to effect pivotal movement of said actuating arms and rotation of said vanes in unison with and in response to rotation of said unison ring about said longitudinal axis while permitting relative radial thermal growth between each of said actuating arms and said unison ring during temperature changes incident to operation of said turbomachine, three radially inwardly directed attachment nodes on said unison ring spaced at equal angular intervals around said unison ring, three push-pull elements capable of force transmission only lengthwise disposed in arcs around said casing portion in interstices between said attachment nodes and in an annulus defined between said unison ring and said casing, each of said push-pull elements having a first end pivotally connected to one of said attachment nodes and a second end pivotally connected to the one of said attachment nodes to which said first end of the next succeeding push-pull element is attached at the attachment of said first end of said next succeeding push-pull element, a corresponding plurality of sheath members each slidably receiving a respective one of said push-pull elements and having rigid attachment at opposite ends generally adjacent respective ones of said attachment nodes to said casing, each of said sheath members directing said first and said second ends of a corresponding one of said push-pull elements generally tangent to a circle in said transverse plane about said longitudinal axis so that said plurality of push-pull elements resist displacement of said unison ring in said transverse plane from centered relationship about said longitudinal axis independently of said bearing and trunnion means with net forces on said attachment nodes directed generally tangent to said circle, a bell crank rotatably disposed on said casing, operating means on said casing connected to said bell crank for effecting rotation of the latter, and connecting means between said bell crank and said unison ring operative to effect rotation of said unison ring about said longitudinal axis in response to rotation of said bell crank.

* * * * *